US005518452A

United States Patent [19]

Stoney et al.

[11] Patent Number: 5,518,452

[45] Date of Patent: May 21, 1996

[54] VENTILATOR

[75] Inventors: Arthur Stoney, Halstead; Arthur J. Burt, Ipswich, both of England

[73] Assignee: Titon Hardware Limited, Stanway

[21] Appl. No.: 402,549

[22] Filed: Mar. 13, 1995

Related U.S. Application Data

[63] Continuation of Ser. No. 20,059, Feb. 22, 1993, abandoned.

[30] Foreign Application Priority Data

Feb. 21, 1992 [GB] United Kingdom ..... 9203720

[51] Int. Cl.[6] ..... E06B 7/02

[52] U.S. Cl. ..... 454/213

[58] Field of Search ..... 454/196, 213, 454/222, 273, 274, 333, 334

[56] References Cited

U.S. PATENT DOCUMENTS

| | | | |
|---|---|---|---|
| 1,016,392 | 2/1912 | Boudrot . | |
| 1,116,625 | 11/1914 | Pomerantz | 454/211 |
| 1,406,841 | 2/1922 | Foss . | |
| 1,947,282 | 2/1934 | Theis . | |
| 3,094,058 | 6/1963 | O'Brien, Jr. et al. | 454/211 X |
| 3,343,475 | 9/1967 | Costley . | |
| 4,702,157 | 10/1987 | Comparon . | |
| 4,727,797 | 3/1988 | Smith . | |
| 4,736,677 | 4/1988 | Smith . | |
| 5,244,434 | 9/1993 | Stoney et al. | 454/213 |

FOREIGN PATENT DOCUMENTS

| | | | |
|---|---|---|---|
| 119045 | 3/1970 | Norway | 454/213 |
| 1417751 | 12/1975 | United Kingdom | 454/211 |
| 1582946 | 1/1981 | United Kingdom . | |

*Primary Examiner*—Harold Joyce

*Attorney, Agent, or Firm*—Price, Heneveld, Cooper, DeWitt & Litton

[57] ABSTRACT

A controllable slot ventilator comprises first and second parallel side walls which define an air passage between them. A closure member is mounted adjacent the front edges of the side walls via parallel motion links, which allow the closure member to move generally away from and towards the side walls to open and close the ventilator. At the rear of the side walls, i.e. the opposite end to the closure member, a mounting flange is fitted, whereby the ventilator is mounted to a member. When the ventilator is installed in a slot, it is preassembled and then inserted into the slot from one end.

11 Claims, 4 Drawing Sheets

VENTILATOR

This is a continuation of application Ser. No. 08/020,059, filed Feb. 22, 1993, now abandoned.

BACKGROUND OF THE INVENTION

The present invention relates to ventilators, more particularly but not exclusively for use in rooms with sealed windows and/or double glazing where it is desirable to provide ventilation without having to open the window. This type of ventilation is now usually referred to as "secondary ventilation".

Secondary ventilation is often achieved by the insertion of a slot ventilator into a slot cut or formed in the sash of a window. Airflow through the resultant ventilation passage between the interior and exterior of the building is controlled by some sort of openable and closeable ventilator such as a hit and miss ventilator or a parallel motion ventilator of the type described in UK patent 1417751. In situations where the "throw" of the ventilator, in other words the distance forward of the main ventilator body by which the facing strip or closure member has to be moved in order fully to open the ventilator, needs to be small, a parallel motion ventilator of the type shown in PCT publication WO 09/08927 may be used.

In a typical arrangement, a slot ventilator has a pair of parallel side plates which in use are positioned within the slot in the window, between which is mounted the pivoting mechanism enabling the facing strip or closure member to be moved between its open and closed positions. At the forward edge of these side plates (that is in use, at the inside of the slot) there is a mounting flange. This acts both to provide a surface against which the facing strip or closure member can seal in its closed position, and also the means by which the ventilator is actually secured to the window. Typically, screw holes are provided at each side of the flange so that the ventilator can be screwed to those parts of the window at the opposite sides of the slot.

A difficulty with this sort of arrangement is that sufficient space has to be provided adjacent the inner end of the slot both to enable the ventilator to be inserted in the slot, and for it to be secured by means of its flange at either side of the slot.

SUMMARY OF THE INVENTION

According to a first aspect of the present invention there is provided a controllable slot ventilator comprising a ventilator housing having an air passage therein, a closure member adjacent the front of the housing, the closure member being movable between a closed position in which it obstructs the air passage, and an open position, characterised by a mounting flange adjacent the rear of the housing. According to narrower aspects of the invention, the front of the housing, having the closure member, will typically be on the inside, so that the closure member can manually be moved between the open and the closed position. Preferably, a manually graspable handle is provided for that purpose. Conversely, the rear of the housing will be on the outside of the window or other section within which the ventilator is positioned in use, and a mounting flange at that location enables the ventilator to be secured from the outside rather than from the inside, which is the conventional arrangement.

According to a second aspect of the invention a controllable slot ventilator comprises first and second parallel side walls defining there-between an air passage, a closure member adjacent respective front edges of the side walls, the closure member being movable between a closed position in which it obstructs the air passage, and an open position, characterised by a mounting flange adjacent respective rear edges of the side walls.

According to a further aspect of the invention there is provided a method of securing a slot ventilator to a window or other section, comprising pre-assembling the ventilator, pushing the ventilator into a slot in the section from one end of the slot, and securing the ventilator to the section from the said one end of the slot, characterised in that the ventilator is manually operable from the other end of the slot.

The invention may be carried into practice in a number of ways and one specific embodiment will now be described, by way of example, with reference to the accompanying drawings in which:

DETAILED DESCRIPTION OF THE PREFERRED EMBODIMENTS

Figure 1A:
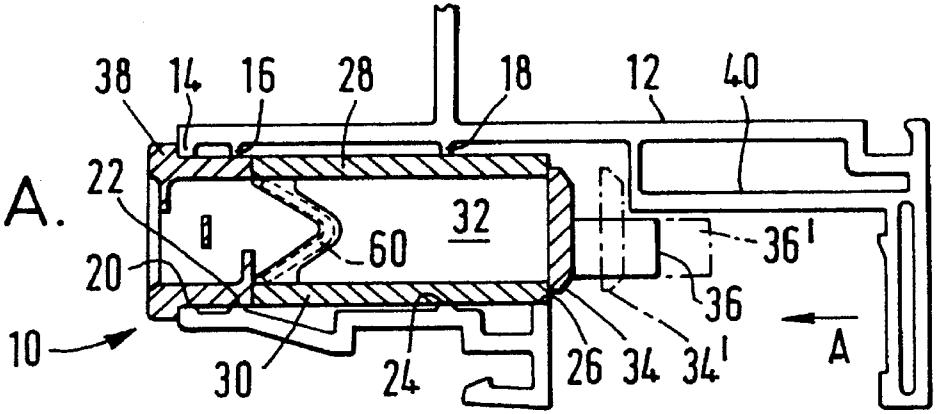
FIG. 1A is a cross-section through a ventilator embodying the present invention, in position with a window section.

The slot ventilator 10 of the present invention is shown in position within a window section 12 in FIG. 1A. The window section 12 is preferably extruded, and may be of aluminium, PVC or any other suitable material. The section shown in FIG. 1A represents the top of a sliding sash window, and as may be seen the section 12 is provided with a slot extending between the inside of the window (on the right hand side as shown in the drawing) and the outside. The upper part of the slot is defined by the ribs 14, 16, 18 and the lower part of the slot by the ribs 20, 22, 24, 26. Within this slot is located the slot ventilator generally indicated at 10.

Figure 1B:
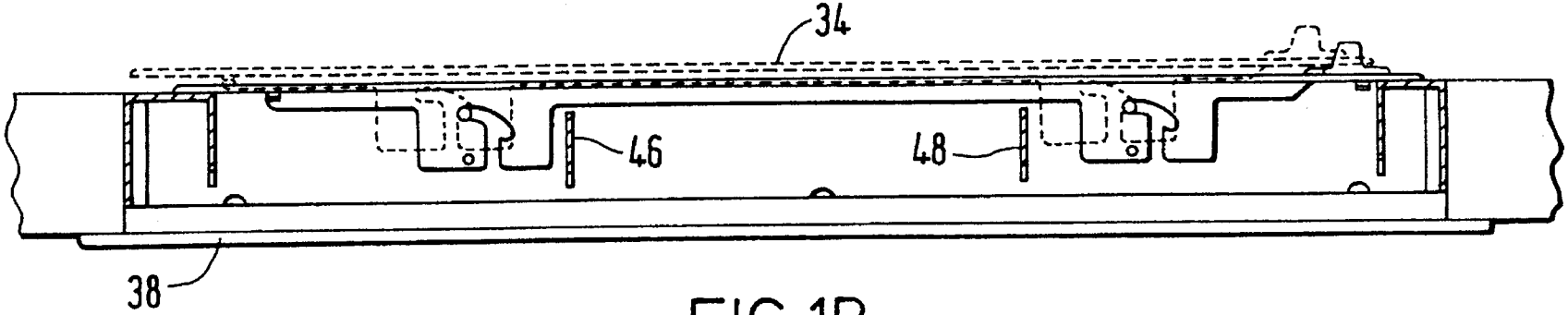
FIG. 1B is a longitudinal schematic section through the ventilator of FIG. 1A.

The body of the ventilator consists of upper and lower side plates 28,30 which between them define an air channel 32. A facing strip or closure member 34 can be moved between the position shown in FIG. 1, in which it closes the air channel 32, and an open position 34' in which it is spaced away from the air channel so allowing airflow between the inside of the window and the outside. The closure member is actuated manually by means of a handle 36, the position of which in the open position is indicated by the reference numeral 36'. The means whereby the closure member is mounted upon parallel motion links for movement between the open and closed positions is not shown in the drawings, but is conveniently shown in PCT publication WO 90/08927. In the rest of this discussion, the presence of a mechanism such as is shown in that publication will be assumed.

As may be seen in FIG. 1A, the handle 35 is mounted in an offset position on the closure member 34 (downwardly of the centre line of the closure member) so as to avoid a box section portion 40 of the window section 12.

Figure 3A:
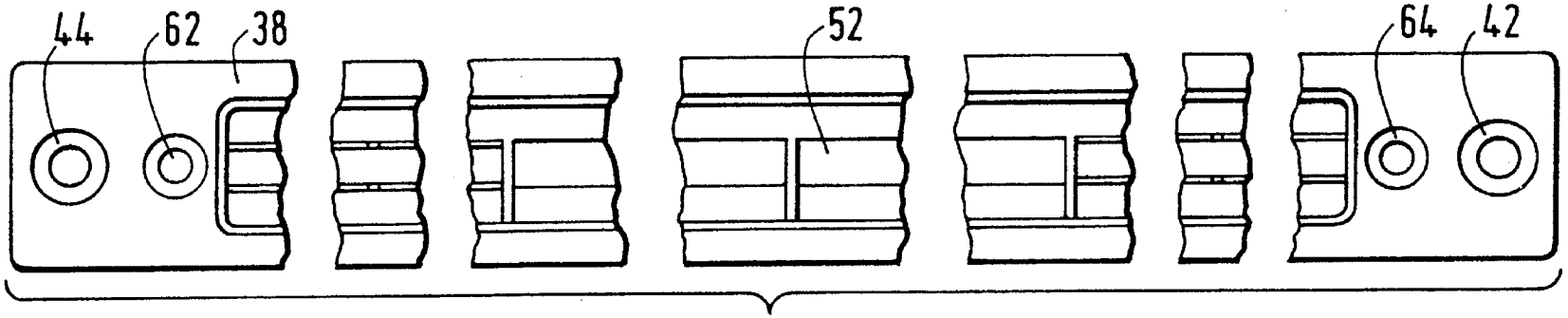
FIG. 3A is a rear plan view of the grille of the ventilator.
Figure 3B:
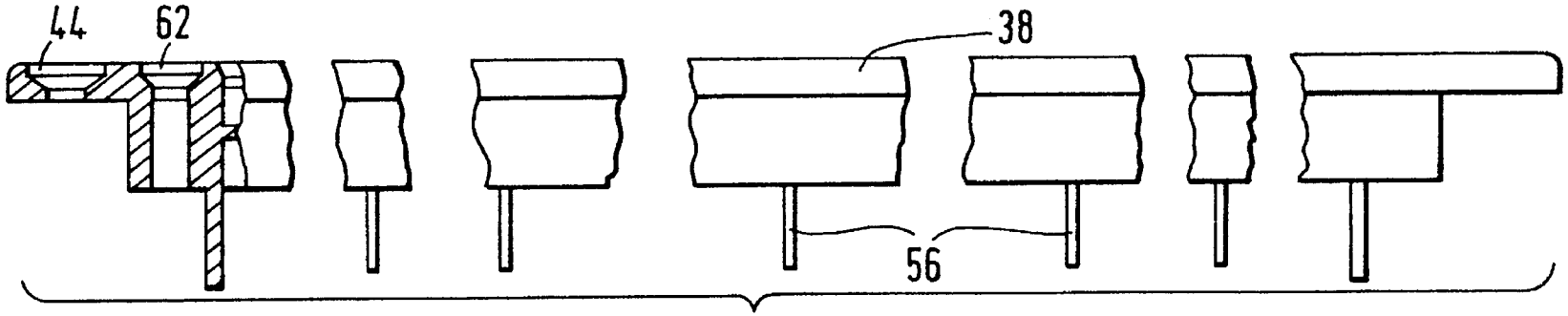
FIG. 3B is a side view, partly in section, of the grille of FIG. 3A.
Figure 3C:
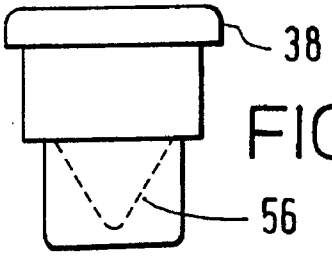
FIG. 3C is a view from one end of the grille of FIG. 3A.

At the rear of the side plates 28.30 there is a mounting flange 38 which will be described later in more detail with reference to FIG. 3. The flange extends laterally on either side of the slot, and is provided with screw holes 42,44 (FIGS. 3A,3B) enabling the slot ventilator 10 to be secured within the window section 12.

Turning now to FIG. 2, there is shown the channel portion of the ventilator 10, that is that portion which defines the side plates 28,30 of the ventilator and which serves to mount the pivoting mechanism (not shown). Between the side plates are a pair of round pegs, 43,45 which are used to support the pivoting mechanism (not shown) and two strengthening webs 46,48. At the ends of the channel portion there are mounting slots which are generally indicated in FIG. 2A by the reference numerals 52,54 and which are shown in more detail in FIG. 2D. As will be seen in that FIG, a slot 56 is provided between the two halves of the channel portion, to receive a screw. Three semi-circular drainage holes are provided in the lower rear edge of the channel portion.

FIG. 3 shows a grille, again moulded out of a plastics material, and which in the completed ventilator is mounted at the rear, next to the two side plates 28,30. The outer portion of the grille comprises the flange which has already been discussed with reference to FIG. 1A. At the ends of the flange 38 there are the two screw holes 42,44 by which the flange and hence the entire ventilator is secured to the window section 12. Airflow through the channel 32 (FIG. 1A) passes through air passages 58 in the grille. The grille is provided with webs 56 along its length. Over these is positioned a fly mesh 60 which is shown generally in FIG.

Figure 2A:
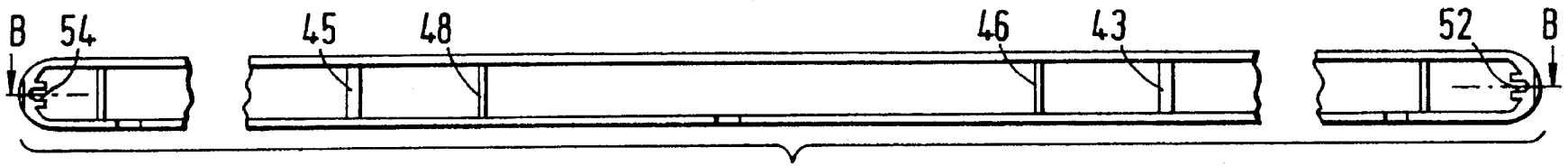
FIG. 2A is a rear plan view of the channel portion of the ventilator.
Figure 2B:
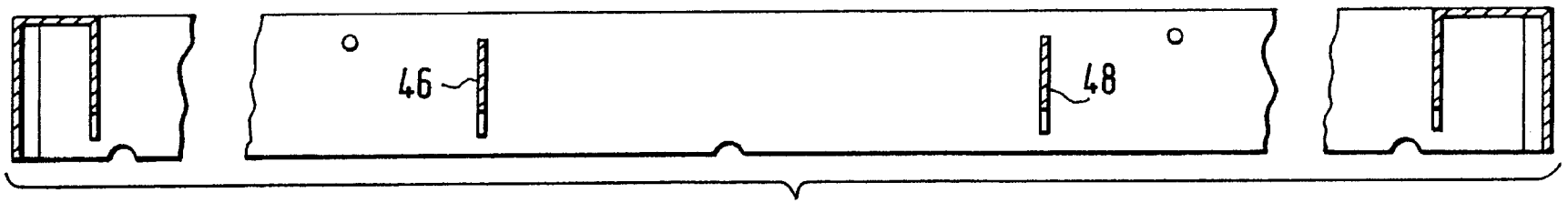
FIG. 2B is section along the line BB of FIG. 2A.
Figure 2C:
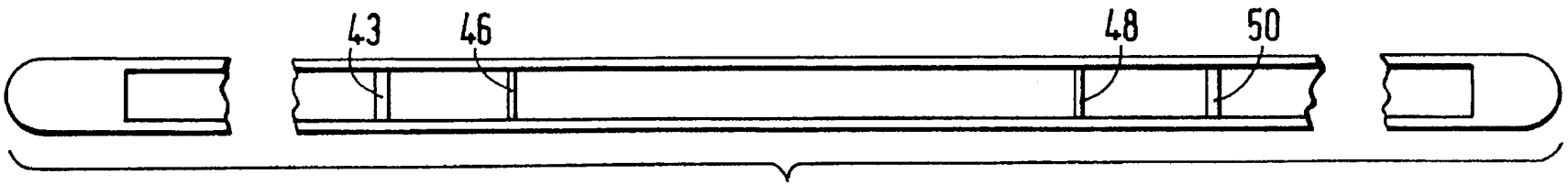
FIG. 2C is a front plan view of the channel sections of the ventilator.
Figure 2D:
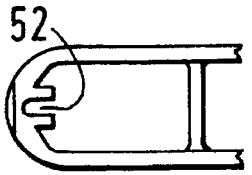
FIG. 2D shows in detail the slots for the screws.
Figure 4A:
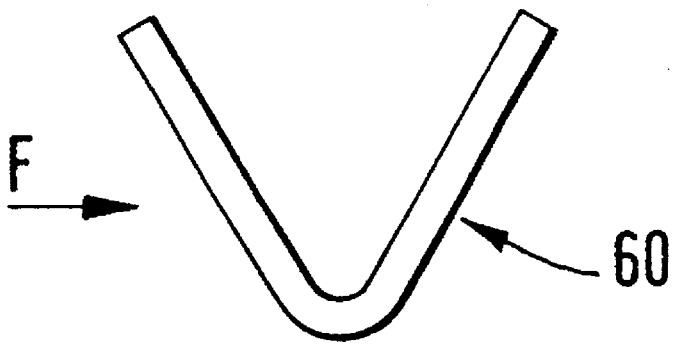
FIG. 4A is an end view of the mesh.
Figure 4B:
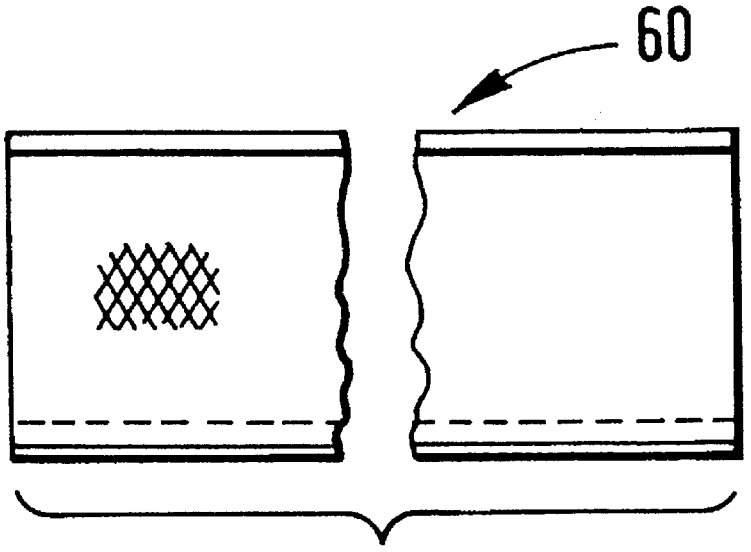
FIG. 4B is a view in the direction of the arrow F of FIG. 4A.

To assemble the ventilator the pivoting mechanism (not shown) and the closure member 34 are attached to the channel portion. The grille (FIG. 3) has the mesh (FIG. 4) placed onto the webs 56, as discussed above, and the mesh and grille assembly is then mounted onto the rear of the partially assembled ventilator, between the side plates 28,30. The grille and mesh are held in position by screws (not shown) which pass through screw holes 62,64 in the flange 38 (FIG. 3A) and into the slots 52,54 of the channel portion (FIG. 2A). The fully assembled ventilator is then pushed into the slot in the window section 12 (FIG. 1) from the rear, that is from the outside of the window. It is then secured in position by screwing the flange 38 to the window via the screw holes 42,44.

Accordingly, a ventilator is disclosed which is designed to be located in use within a slot within a window or other section. It is secured in position within the slot by means of the mounting flange, which may have screw holes or other mounting means enabling it to be secured to the window or other section at each side of the slot. The rest of the ventilator, with the exception of the mounting flange, should desirably be sized so that the entire ventilator can be pre-assembled and then merely inserted into the slot from the rear (that is, from the outside). Such an arrangement differs from known ventilators in that typically there is a mounting flange at the front of the ventilator, and the ventilator is either surface mounted to the front (inside) of the slot or it is pushed into the slot from the inside. The present arrangement allows for considerably more flexibility to the inner profile of the window or other section, and it may be desirable for aesthetic or functional reasons to have a profile which is so close to the front of the slot, perhaps even partially obscuring it, that it would foul a conventional ventilator or at least prevent such a ventilator from being pre-assembled and simply pushed into the slot.

The ventilator is preferably of a parallel motion type, in which the closure member comprises a flat plate which moves in a direction generally perpendicular to its surface between the closed and open position. To that end, parallel motion links such as, for example, those described in PCT publication W090/08927 may be provided.

The first and second parallel side walls may themselves define the body or the housing of the ventilator which is desirably molded or extruded from plastic material.

The mounting flange could either be integral with the sidewalls or, in a preferred embodiment, the mounting flange could form part of a separate grille unit which is located adjacent to respective rear edges of the sidewalls. The grille unit or mounting portion may be secured to the sidewalls by any convenient means, for example, by being screwed thereto. In one form of the invention, the mounting flange has screw holes through which securing screws pass, these screws being received within bores or slots connected to or forming part of the sidewalls. For example, the two sidewalls may have a grille mounting portion for which a slot is provided.

Between the rear grille and the front closure member there may be provided a mesh, for example, to prevent flies and other insects from passing through the air passage. The mesh may be secured to the grille, for example, as a push fit, before the grille is itself secured to the body of the ventilator during assembly. Alternatively, the mesh may be trapped between the grille and sidewalls.

Where the closure member has a manually operable handle, the handle may be offset from the center line of the closure member, to ensure, if necessary, that the handle clears the interior portion of the window or other section.

According to another aspect of the invention, there is provided a method of securing a slot ventilator to the window or other section, comprising pre-assembling the ventilator, pushing the ventilator into a slot in the section from one end of the slot, and securing the ventilator to the section from the said one end of the slot, characterized in that the ventilator is manually operable from the other end of the slot. Preferably, the fixing is achieved by means of a mounting flange which is secured to the section at a position adjacent said one end of the slot.

These and other modifications to the preferred embodiment described herein can be made by those skilled in the art without departing from the spirit or scope of the invention as defined in the appended claims.

We claim:

1. A preassembled controllable slot ventilator comprising:

first and second parallel side walls defining therebetween an air passage;

a closure member preassembled to said first and second parallel side walls, the closure member being movable between a closed position in which said closure member is located against respective front edges of the side walls to obstruct the air passage, and an open position in which said closure member is located forward of the front edges of the side walls; and a mounting flange adjacent a rear edge of at least one of the side walls opposite said closure member; wherein said closure member and said first and second side walls define said ventilator with a shape and size which enable said ventilator to be inserted forward into an installed position in a slot with the mounting flange abutting a surrounding surface of a structure defining the slot in an installed position.

2. A preassembled controllable slot ventilator as defined in claim 1, wherein said first and second side walls define a housing of the ventilator.

3. A preassembled controllable slot ventilator as defined in claim 2, wherein said housing is molded from a plastic material.

4. A preassembled controllable slot ventilator as defined in claim 2, wherein said housing comprises an extrusion.

5. A preassembled controllable slot ventilator as defined in claim 2 in which said closure member defines a front facing strip of the ventilator and in the closed position forms a front wall of said housing, said front wall extending across said air passage between said front edges of said first and second parallel side walls.

6. A preassembled controllable slot ventilator as defined in claim 1 in which said mounting flange is part of a separate grille unit located adjacent said rear edges of said side walls.

7. A preassembled controllable slot ventilator as claimed in claim 5 further including a mesh attached between said first and second side walls to block insects from passing through said air passage.

8. A method of securing a slot ventilator in a cooperating slot having a front face and a rear face, comprising the steps of:

providing a pre-assembled slot ventilator having front and rear sides and having a closure member operably positioned at the front side;

inserting the front side of the ventilator into the rear face of the cooperating slot;

pushing the ventilator into the cooperating slot; and securing the ventilator in the cooperating slot at said rear face of the slot, the ventilator being manually operable from the front face of the cooperating slot.

9. A method as defined in claim 8 in which said step of securing further includes providing a mounting flange at said rear side of said ventilator.

10. A method as defined in claim 9 in which said pushing the ventilator into the cooperating slot comprises pushing the ventilator into the slot until said flange abuts against a surrounding surface of a structure defining said cooperating slot.

11. A method as claimed in claim 8 in which said pushing the ventilator into the cooperating slot includes moving said closure member from said rear face of said slot to said front face of said slot.

* * * * *